US011564476B2

(12) United States Patent
McGuire

(10) Patent No.: US 11,564,476 B2
(45) Date of Patent: Jan. 31, 2023

(54) SALON TOOL STORAGE ASSEMBLY AND METHOD OF USE

(71) Applicant: Mark McGuire, Clayton, NC (US)

(72) Inventor: Mark McGuire, Clayton, NC (US)

( * ) Notice: Subject to any disclaimer, the term of this patent is extended or adjusted under 35 U.S.C. 154(b) by 0 days.

(21) Appl. No.: 17/445,756

(22) Filed: Aug. 24, 2021

(65) Prior Publication Data

US 2022/0386760 A1 Dec. 8, 2022

Related U.S. Application Data

(60) Provisional application No. 63/070,345, filed on Aug. 26, 2020.

(51) Int. Cl.
*A45D 44/06* (2006.01)
*A47F 5/00* (2006.01)
*A47F 7/00* (2006.01)

(52) U.S. Cl.
CPC ..... *A45D 44/06* (2013.01); *A47F 5/00* (2013.01); *A47F 7/0021* (2013.01)

(58) Field of Classification Search
CPC ..... A45D 44/02; A45D 44/06; A45D 44/14; A45D 20/00; A45D 20/10; A45D 20/12; A45D 2020/126; A45D 44/04; A47F 5/00; A47F 7/00; A47F 7/0021; B26B 19/38; B26B 19/3833; A47B 67/005; A47B 67/02; A47B 81/00
See application file for complete search history.

(56) References Cited

U.S. PATENT DOCUMENTS 4,101,756 A * 7/1978 Yamano ..... A45D 1/20 219/242
4,159,773 A 7/1979 Losenno
4,446,972 A * 5/1984 Sussman ..... A47G 29/08 211/60.1
4,658,114 A * 4/1987 Hong ..... A45D 4/16 132/229
4,979,524 A * 12/1990 Anderson ..... A45D 44/02 132/202
5,064,154 A * 11/1991 Payne ..... A45D 20/12 248/314
5,124,532 A * 6/1992 Hafey ..... A45D 1/00 132/229
5,370,452 A * 12/1994 Baer ..... A45D 44/04 312/276
5,379,903 A * 1/1995 Smith ..... H02G 11/02 132/289
5,485,931 A * 1/1996 Barr, Jr. ..... A47F 5/08 248/314
5,547,393 A * 8/1996 Jansen ..... A45D 44/02 219/242
5,577,819 A * 11/1996 Olsen ..... A47B 81/00 312/209

(Continued)

OTHER PUBLICATIONS

United States Patent and Trademark Office, International Search Report in PCT application PCT/US2022/041233, dated Nov. 15, 2022, 12 pages.

*Primary Examiner* — Devin K Barnett
(74) *Attorney, Agent, or Firm* — Hooker & Habib, P.C.

(57) ABSTRACT

A storage assembly for corded salon tools, particularly a storage assembly adapted for the storage of one or more corded hair styling tools in a compact configuration with easy access and a reduced risk of cord entanglement.

19 Claims, 7 Drawing Sheets

(56) References Cited

U.S. PATENT DOCUMENTS 5,615,782 A * 4/1997 Choe ..... A45D 44/02 211/60.1
5,743,415 A * 4/1998 Smart ..... A45D 20/12 248/314
5,749,379 A * 5/1998 Stillwagon ..... G01K 1/14 219/242
5,794,799 A * 8/1998 Collins ..... A45D 1/28 219/242
5,875,794 A * 3/1999 Ekman ..... A45C 5/005 206/581
5,917,694 A * 6/1999 Denny ..... A45D 44/02 248/314
5,924,892 A * 7/1999 Ferracina ..... H01R 13/72 439/535
6,123,299 A * 9/2000 Zach, Sr. ..... A45D 1/00 248/314
6,305,388 B1 * 10/2001 Zeller ..... A45D 44/02 132/287
6,331,121 B1 * 12/2001 Raeford, Sr. ..... H01R 13/72 174/67
D467,390 S * 12/2002 Lewis ..... D28/38
D469,927 S 2/2003 Petruccelli
6,581,890 B2 * 6/2003 Johnson ..... A45D 44/04 248/176.1
6,591,952 B1 * 7/2003 Randall ..... A45D 44/02 191/12.4
D487,170 S 2/2004 Petruccelli
6,702,608 B2 * 3/2004 Brennan, Jr. ..... B25H 3/00 439/501
6,703,587 B2 3/2004 Sena
6,769,554 B1 * 8/2004 Udofiah ..... A45D 44/06 211/85.3
6,805,581 B2 * 10/2004 Love ..... H01R 13/447 439/367
6,844,494 B1 * 1/2005 Nevins ..... H01R 25/003 174/53
D508,346 S 8/2005 Petruccelli
D509,082 S 9/2005 Petruccelli
7,168,538 B2 1/2007 Pena
D552,796 S 10/2007 Petruccelli
D603,095 S * 10/2009 Petruccelli ..... D28/38
7,617,936 B2 * 11/2009 Barnett, Jr. ..... B65D 25/06 206/576
7,909,162 B1 * 3/2011 Barrett ..... A45D 44/00 132/286
D640,003 S * 6/2011 Gilbert ..... D28/38
D682,592 S * 5/2013 McKenna ..... D6/559
8,522,969 B2 9/2013 Mason
8,544,623 B1 * 10/2013 Murphy ..... H02G 11/02 191/12.4
8,636,016 B1 * 1/2014 Lee ..... A45D 44/04 132/286
8,689,999 B2 * 4/2014 Cooper ..... A45D 44/04 206/823
8,870,307 B1 * 10/2014 Provenzano ..... A45D 44/02 312/224
9,013,071 B1 * 4/2015 Levi ..... A45D 20/14 312/351
D734,541 S 7/2015 Petruccelli
9,307,837 B2 * 4/2016 Wood ..... A47B 67/02
D763,511 S 8/2016 Petruccelli
D770,684 S 11/2016 Petruccelli
9,484,693 B1 * 11/2016 Richter ..... H02G 11/02
9,490,599 B2 11/2016 Griffith
9,675,172 B2 * 6/2017 Pandorf ..... A47B 67/02
9,788,626 B2 10/2017 Pedroarena
9,857,071 B2 * 1/2018 Cano ..... F21S 4/24
9,949,554 B2 4/2018 Sullivan
9,955,773 B1 * 5/2018 Tavella ..... A45D 44/04
10,039,358 B2 * 8/2018 Hanson ..... A45C 11/24
10,299,569 B1 * 5/2019 Taylor ..... H01R 25/006
10,413,058 B2 8/2019 Kuhn
10,574,067 B1 * 2/2020 Hanson ..... H01R 25/003
D901,075 S * 11/2020 Advani ..... D28/13
11,070,038 B2 * 7/2021 Chambers ..... A47B 88/919
2002/0050546 A1 5/2002 Johnson et al.
2003/0222069 A1 * 12/2003 Sena ..... A45D 20/12 219/222
2005/0284856 A1 * 12/2005 Cafaro ..... A45D 1/04 219/222
2006/0141855 A1 * 6/2006 Bloom ..... H01R 13/72 439/501
2007/0283978 A1 * 12/2007 Montagnino ..... A45D 1/04 132/211
2008/0029428 A1 * 2/2008 Kolada ..... H01R 24/78 361/601
2008/0280459 A1 11/2008 Bova
2009/0295110 A1 * 12/2009 Wilsher ..... A47B 67/005 280/47.35
2011/0062039 A1 3/2011 Prokop
2013/0037443 A1 * 2/2013 Mason ..... B25H 3/02 206/702
2013/0175415 A1 * 7/2013 Mathieu ..... A45D 44/06 248/176.2
2015/0282596 A1 10/2015 Davis
2016/0081458 A1 * 3/2016 Sullivan ..... A45D 44/06 361/679.01
2016/0270516 A1 * 9/2016 Stephens ..... A45D 44/02
2017/0099945 A1 * 4/2017 Meads ..... A47G 1/00
2017/0215556 A1 * 8/2017 Sullivan ..... F16M 11/04
2017/0373515 A1 * 12/2017 Friday-Skoda ..... H02J 7/0013
2018/0310711 A1 * 11/2018 Kuhn ..... A47B 88/437
2020/0130982 A1 4/2020 Smith et al.
2021/0145152 A1 5/2021 Rey

* cited by examiner

SALON TOOL STORAGE ASSEMBLY AND METHOD OF USE

This disclosure relates generally to devices for the storage of hair salon and barber shop accessories. Specifically, the disclosure is of a storage assembly for use in hair salons or barber shops. The disclosed assembly allows for the storage of multiple corded hair styling tools in a compact configuration with easy access to tools and reduced risks of cord entanglement and tripping hazards.

BACKGROUND OF THE DISCLOSURE

Corded hair styling tools such as clippers, curling irons, hair driers and the like are regularly used in hair salons and barber shops.

The storage of stylists' tools in a salon or barber shop environment is problematic. Hair salons tend to have multiple work stations for hair stylists. Such work stations must meet the dimensional requirements of commercial floor plans. Floor plans defining multiple work stations necessitate compact work station configurations. For instance, conventional salon and barbershop floor plans allow work stations to have a width of five to six feet. Such dimensional limitations limit available storage space for a stylist's equipment which typically includes a number of corded styling tools.

It is customary for salon stations to store styling tools having the cords plugged into an electrical socket to facilitate tool use during styling sessions. Sessions often require the repeated removal and replacement of tools, through which cords become tangled and entwined with one another. This complicates a stylist's use of tools, creates a visually unattractive tangle of cords, can damage cords over time and can create tripping hazards at work stations.

While storage station for the storage of multiple corded hair styling tools within a salon are known, these stations do not properly account for the storage of multiple, plugged-in corded hair styling tools for use in a salon station within compact salon dimensional requirements.

A primary problem with existing storage systems is that they do not appropriately accommodate styling tool cords which are typically eight feet in length or longer. Without attention to the recoiling and locating of cords of such length after each use, portions of such cords become entangled with themselves and/or with other stored cords. As a stylist typically must use and reuse corded tools over work sessions without the time to address cord management, cord entanglement becomes inevitable.

Existing storage systems fail to allow for the easy removal and replacement of corded hair styling tools within a compact salon work station. Known systems do not fit well within work stations and cannot be easily accessed by a stylist multiple times over work sessions. As the storage of hot corded hair styling tools such as curling irons, hair straighteners, hair dryers and the like must be conducted with care within a compact work station floor plan to prevent potential stylist and client burn risks, this storage problem is exacerbated.

Thus, there is a need for an improved salon tool storage system that overcomes these problems.

SUMMARY OF THE DISCLOSURE

Disclosed herein is a salon tool storage assembly and its method of use. The assembly is adapted for installation within the existing structure of an existing salon or barber salon work station or for inclusion with new station builds.

The assembly is adapted for installation within the boundaries of compact salon and barber salon work stations to allow storage and access to multiple corded styling tools for repeated removal and replacement over styling sessions without tangling or entwining tool cords. The assembly allows for the secure and safe storage of hot corded hair styling tools to overcome the potential burn contact.

The assembly allows for the storage of multiple corded styling tools so that tool cords are retained above a salon site floor to eliminate tripping hazards.

Other objects and features of the disclosure will become apparent as the description proceeds, especially when taken in conjunction with the accompanying drawing sheets illustrating the assembly and its method of use.

DETAILED DESCRIPTION

FIGS. 1 through 7 disclose a first embodiment storage assembly 10.

Storage assembly 10 has a support column 12. Support column 12 has a generally rectangular cubic body 14 and may be formed from a rigid material including wood, plastics, metals or the like.

Figure 4:
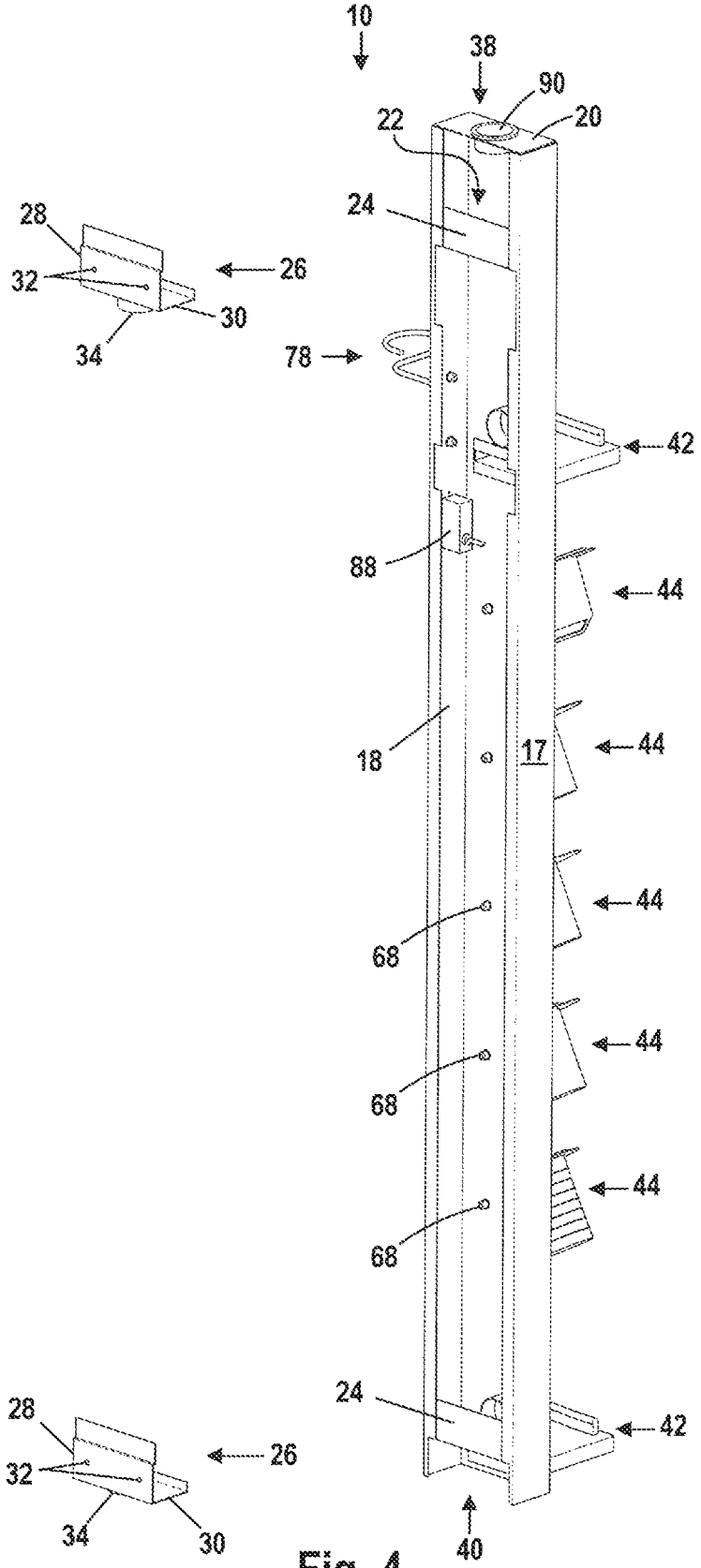
FIG. 4 is a rear view of the assembly.
Figure 5:
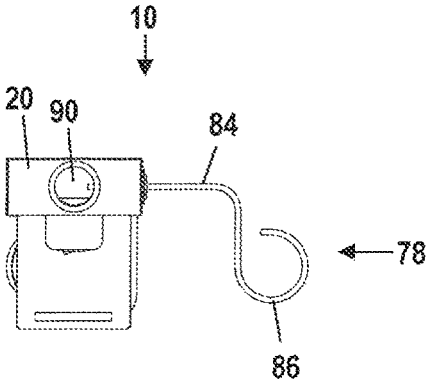
FIG. 5 is a top view of the assembly.
Figure 6:
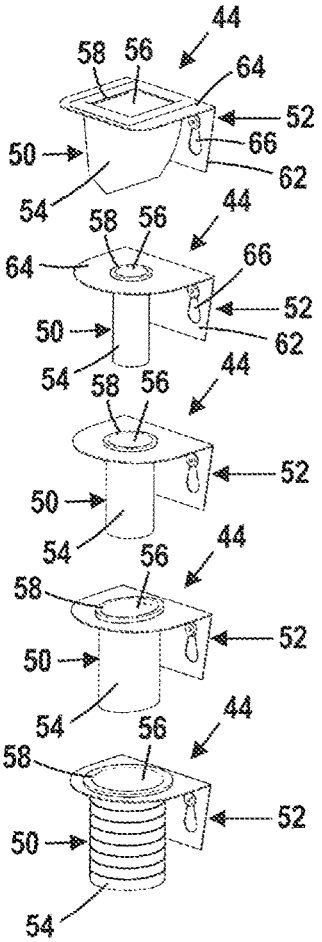
FIG. 6 provides detail perspective views of a number of salon tool supports for use with the assembly.

As shown in the figures, support column 12 may be made up of a number of body walls including a front wall 16, opposed side walls 17, 18 and top wall 20. Walls 16, 17, 18, 20 generally define an internal cavity 22. In embodiments, support column 12 may include one or more rear beams 24 extending between opposed side walls 17, 18 as shown in FIG. 4 to provide rigidity to column 12. In embodiments, beams 24 may be adapted to engage mounting brackets 26. As shown in the figures, mounting brackets 26 may be generally L-shaped, having bracket rear wall 28 and internal wall 30. Rear wall 28 may have apertures 32 extending therethrough to facilitate affixing brackets 26 to a vertical wall or like mounting surface with a conventional fastener.

Internal wall 30 may include a wire aperture 34 to facilitate the routing of wires within internal cavity 22 as explained in greater detail herein.

Support column 12 front wall 16 is generally rectangular in shape having a major vertical axis 36 extending from column top 38 to column bottom 40. In embodiments, support column 12 may extend approximately 66 inches between column top 38 and column bottom 40.

Support column 12 front wall 16 includes a number of storage shelves 42 and salon tool supports 44.

As shown in the figures, storage shelves 42 may be generally rectangular in shape, extending normally from front wall 16 and having an upwardly-extending retention lip 46. In embodiments, front wall 16 may include one or more cord apertures 48 located above a storage shelf 42 and extending through front wall 16 to internal cavity 22 to facilitate the routing of wires as explained in greater detail herein.

Salon tool supports 44 are made up of a tool capture element 50 and a support mounting bracket 52.

Tool capture element 50 is made up of a single curved wall 54 or multiple flat walls 54 which define a tool capture cavity 56 having a cavity mouth 58. In embodiments, walls 54 and cavity 56 may have a generally cylindrical shape adapted to engage a generally cylindrical portion of a salon tool. In alternate embodiments, rectangular walls 54 and cavity 56 may have different shapes adapted to appropriately engage like-shaped portions of a salon tool. See FIG. 6.

Support mounting bracket 52 may be generally L-shaped, having a mounting wall 62 and a flange wall 64. Mounting wall 62 includes a pair of mounting apertures 66 to facilitate affixing salon tool supports 44 to front wall 16 through use of a conventional fastener 68. Flange wall 62 includes an aperture through which a corresponding tool capture element 50 is attached.

Figure 1:
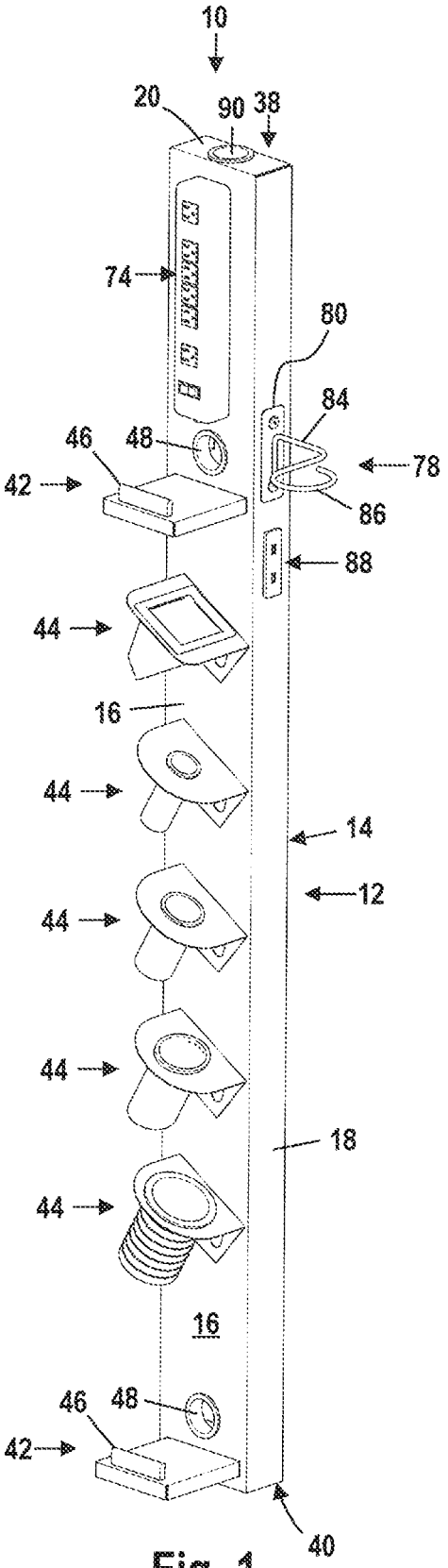
FIG. 1 is a perspective view of the disclosed assembly.
Figure 2:
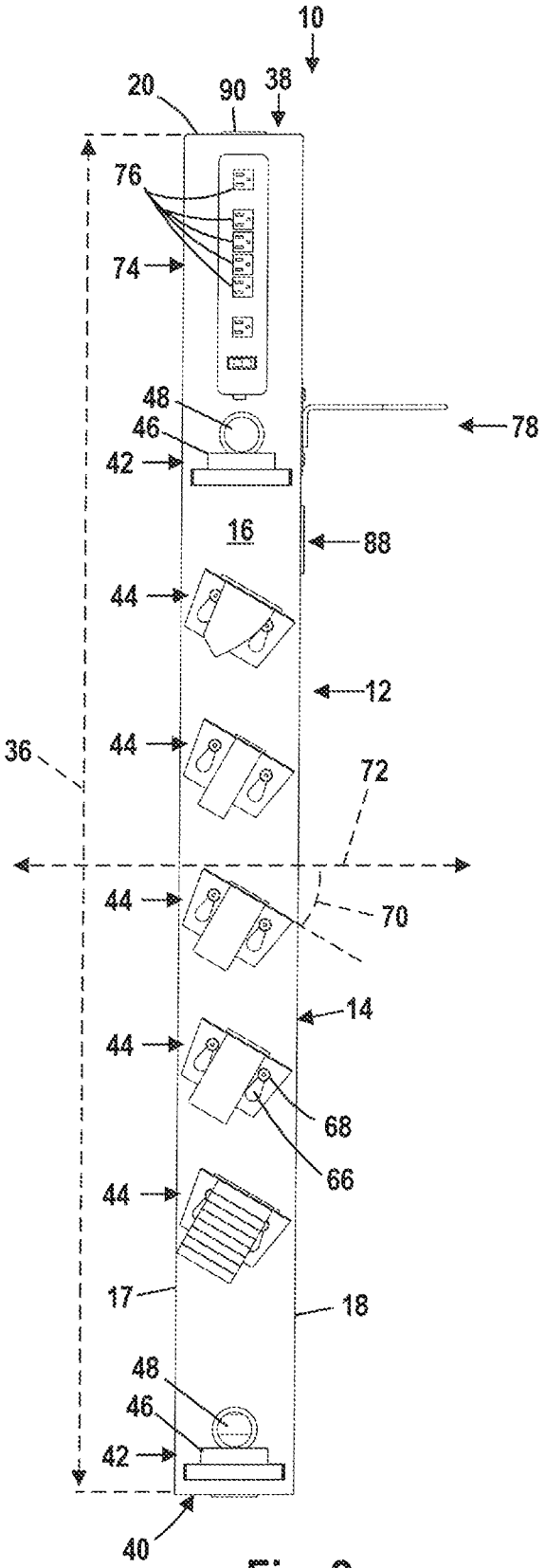
FIG. 2 is a front view of the assembly.
Figure 3:
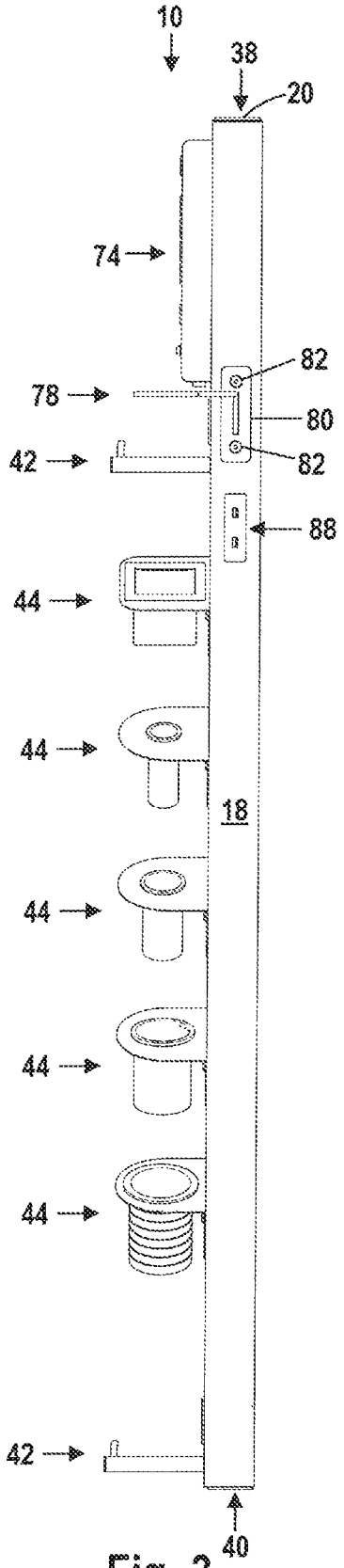
FIG. 3 is a side view of the assembly.

In embodiments, tool capture element 50 may be mounted to front wall 16 at an angle 70 relative to minor horizontal axis 72 extending perpendicularly to major axis 36. Likewise, flange wall 64 and cavity mouth 58 are located at like angle 70 relative to minor axis 72. In assembly 10, this orients flange wall 64 and cavity mouth 58 of salon tool supports 44 to generally face toward one side of support column 12. As shown in FIG. 2, this may be toward side wall 18. This configuration facilitates the storage of corded salon tools as explained in greater detail below. In embodiments, angle 70 may be in a range of approximately 10 to 30 degrees.

As shown in the figures, assembly 10 salon tool supports 44 may be located in a vertical configuration relative to one another extending generally parallel to major axis 36 as shown in FIG. 2.

While the application figures showing use of five salon tool supports 44, embodiments of assembly 10 are contemplated having a different numbers of salon tool supports 44, including an embodiment having a single salon tool support 44.

Support column 12 front wall 16 also includes an electrical supply 74 mounted proximate column top 38. Electrical supply 74 has one or more electrical outlets 76 adapted for receiving conventional power cord plugs. Electrical outlets 76 may be located in a vertical configuration relative to one another extending generally parallel to major axis 36 as shown in in FIG. 2.

Power may be provided to electrical supply 74 by wires routed through internal cavity 22.

In embodiments, electrical supply 74 may be a multiplex electrical outlet having multiple conventional electrical outlets 76 as shown in the figures. In such embodiments, a power cord for the multiplex electrical outlet is routed through internal cavity 22 to a conventional wall outlet of the like to supply power thereto. In alternate embodiments, electrical supply 74 may also be an electrical utility box or like fixture having one or more conventional electrical outlets with power lines routed through internal cavity 22.

As shown in the figures, electrical supply 74 is located above storage shelves 42 and salon tool supports 44. In embodiments, one or more electrical outlets 76 may be located directly above storage shelves 42 and salon tool supports 44 along a vertical axis parallel to major axis 36.

Support column 12 side wall 18 has a cord-management support 78 mounted thereto by a mounting plate 80 and conventional fasteners 82.

Cord-management support 78 is located generally proximate column top 38 and between electrical supply 74 and salon tool supports 44 along major axis 36.

As shown in the figures, cord-management support 78 may be formed from a generally rigid wire 84 having a loop portion 86 for containing cords therein as explained in greater detail below.

The use of a cord-management support having different elements than support 78 is contemplated, including supports having rigid restraints such as hooks, apertures through solid bodies and the like, flexible restraints such as ties, hooks and loops type ties as well as other elements capable of engaging and securing power cords extending between electrical supply 74 and salon tool supports 44 as explained in greater detail herein.

Support column 12 side wall 18 also has an electrical outlet 88. Electrical outlet 88 may be used to provide power to cells phones, tablets or like objects stored on a proximate shelf 42. As shown in the figures, Outlet 88 may be a USB-type outlet. In alternate embodiments, outlet 88 may be another type of electrical outlet.

Support column 12 top wall 20 has a cord aperture 90. Aperture 90 may be used to route electrical cords or other elements between the exterior of storage assembly 10 and internal cavity 22. Aperture 90 may be used to route electrical cords into internal cavity 22 from a source located above assembly 10, such as a ceiling cavity.

Figure 8:
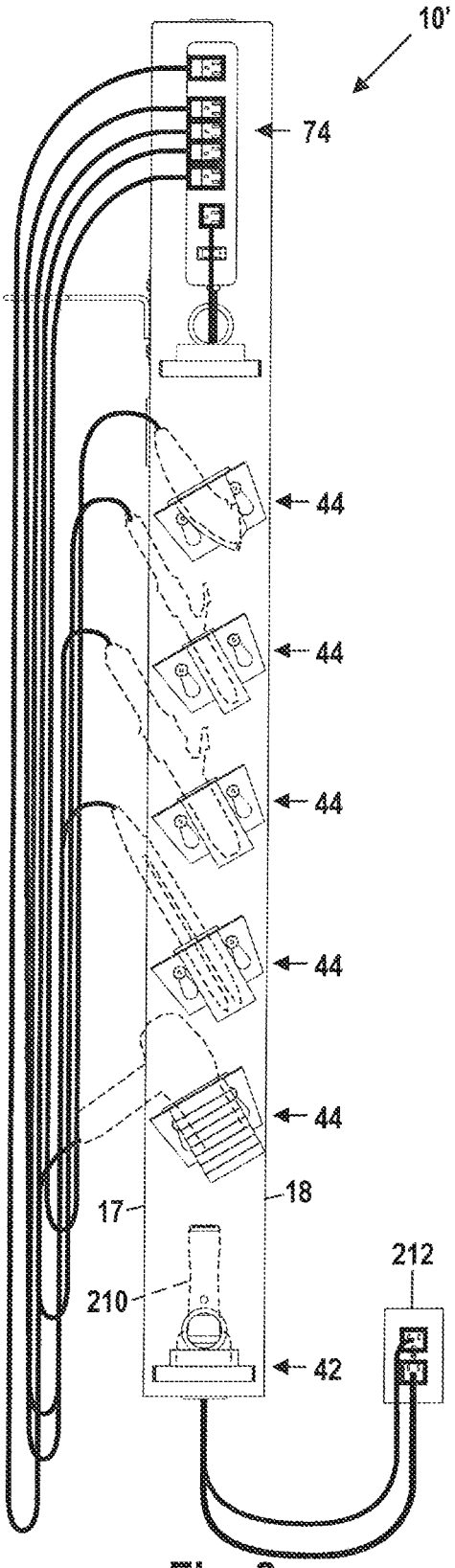
FIG. 8 is front view of the assembly in an alternate configuration having a number of corded styling tools installed therein.
Figure 9:
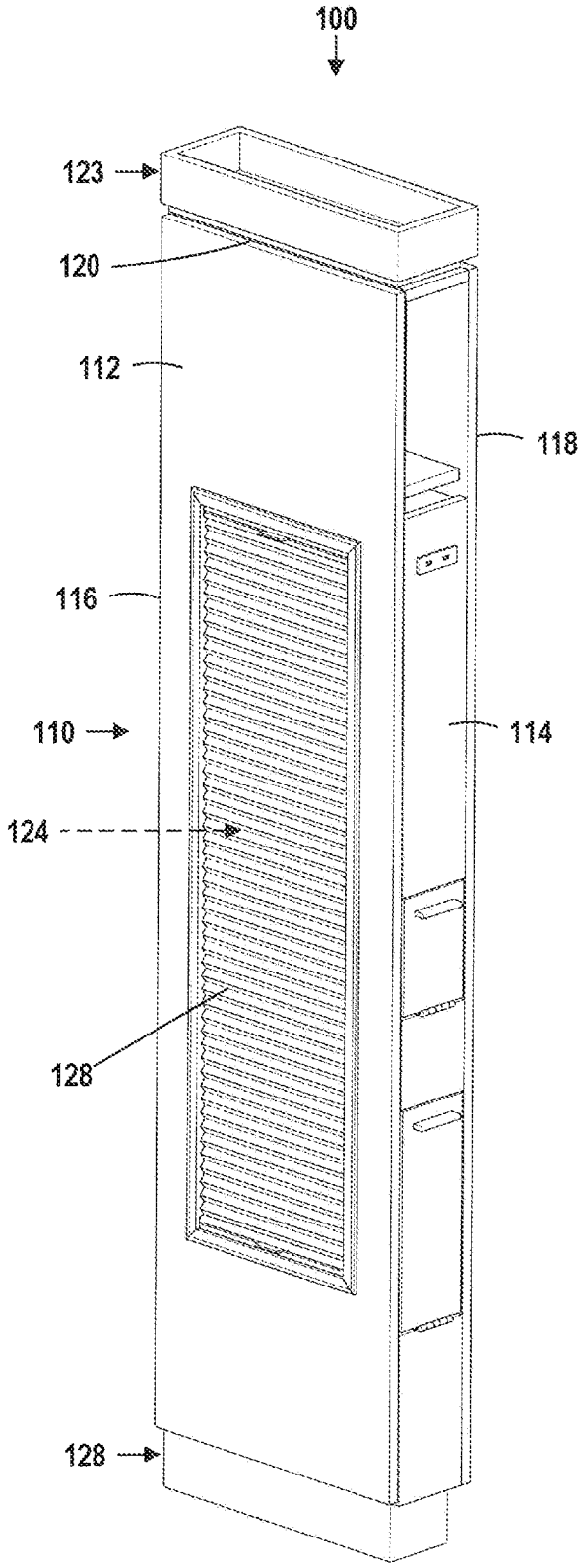
FIG. 9 is a perspective view of a second embodiment assembly.

FIG. 8 shows an alternate configuration assembly 10'. Assembly 10' has a mirror-image configuration to assembly 10 having salon tool supports 44 mounted to front wall 16 so that flange wall 64 and cavity mouth 58 of salon tool supports 44 generally face toward one side of support column 12, in this case toward side wall 17. As with assembly 10, this configuration facilitates the storage of corded salon tools as explained in greater detail below. Specifically use of either allows for the installation of an assembly 10 or 10' that is customizable to specific salon floorplan requirements to allow access to stored tools regardless of other salon structural features such as walls, columns and the like. The use of either assembly 10 or 10' may also facilitate use of assembly 10 by either right-handed or left-handed stylists.

FIGS. 9 through 13 disclose a second embodiment storage assembly 100.

Storage assembly 100 has a rectangular cubic body 110 in the general form of a storage cabinet, and may be formed from a rigid material including wood, plastics, metals or the like.

As shown in the figures, assembly 100 is generally rectangular in shape and is made up of six body walls: right side wall 112, front wall 114, rear wall 116, left side wall 118 and top and bottom walls 120, 122.

In embodiments, assembly 100 may be approximately 84 inches high between top wall 120 and assembly bottom wall 122. In embodiments assembly 100 may be 21 inches wide between front and rear walls 114, 116. In embodiments assembly 100 may by 7 inches deep or more between side walls 112, 118.

In embodiments, assembly 100 may have a top soffit element 123 located above top wall 120. As shown in the figures, top soffit element 123 may be generally rectangular in shape and be used to integrate assembly 100 within certain salon build plans. Top soffit element 123 may be used conceal electrical cords routed to the interior of assembly 100 from a source located above assembly 100, such as a ceiling cavity.

In embodiments, assembly right side wall 112 includes wall opening 124 to allow access to internal assembly storage cavity 126. Opening 124 may include a removable barrier 128 that can be actuated as a physical barrier to allow access through opening 124 into cavity 126. As shown in the figures, barrier 128 may be a set of blinds that is actuated upwardly and downwardly to allow access into cavity 126. Use of other barriers, including one or more flexible curtains, one or more cabinet doors, a sliding glass door, or other barrier means are also contemplated.

Figure 10:
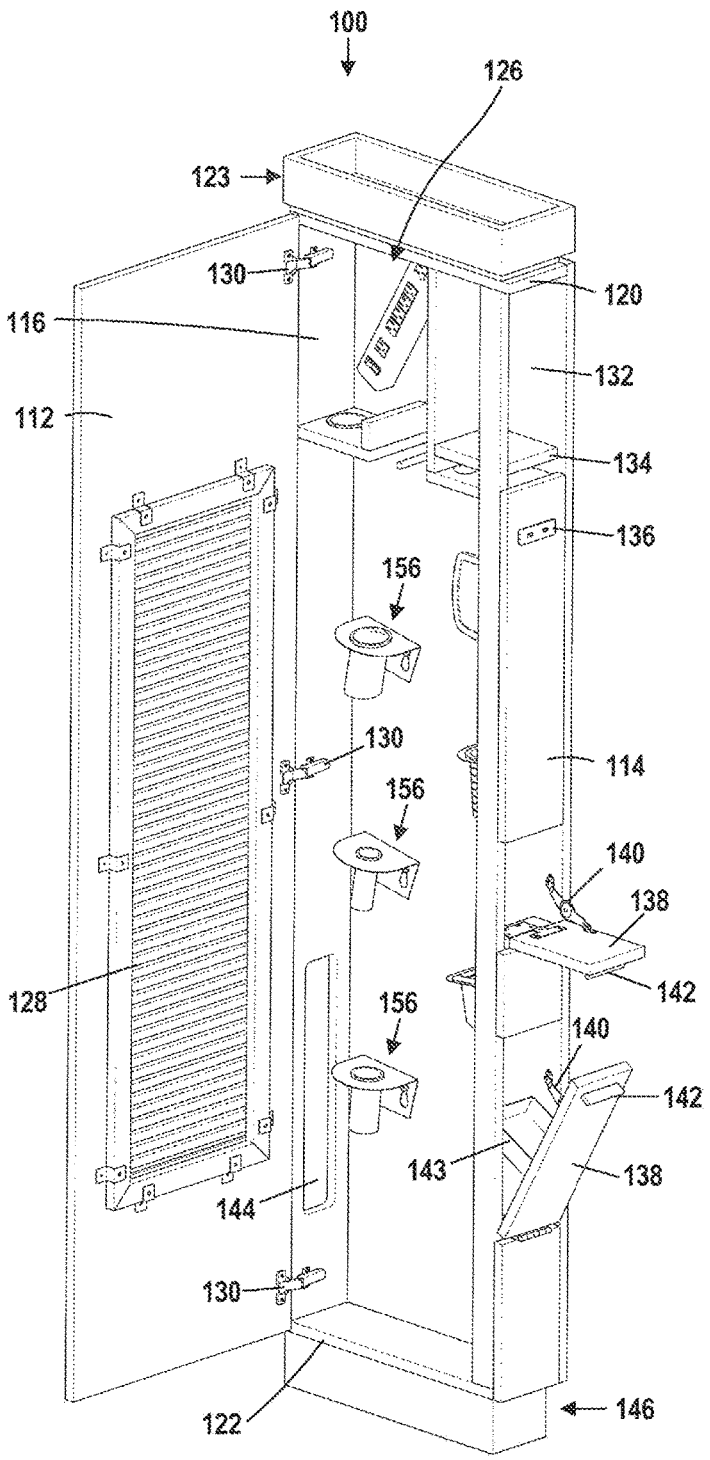
FIG. 10 is an alternate perspective view of the second embodiment assembly.
Figure 11:
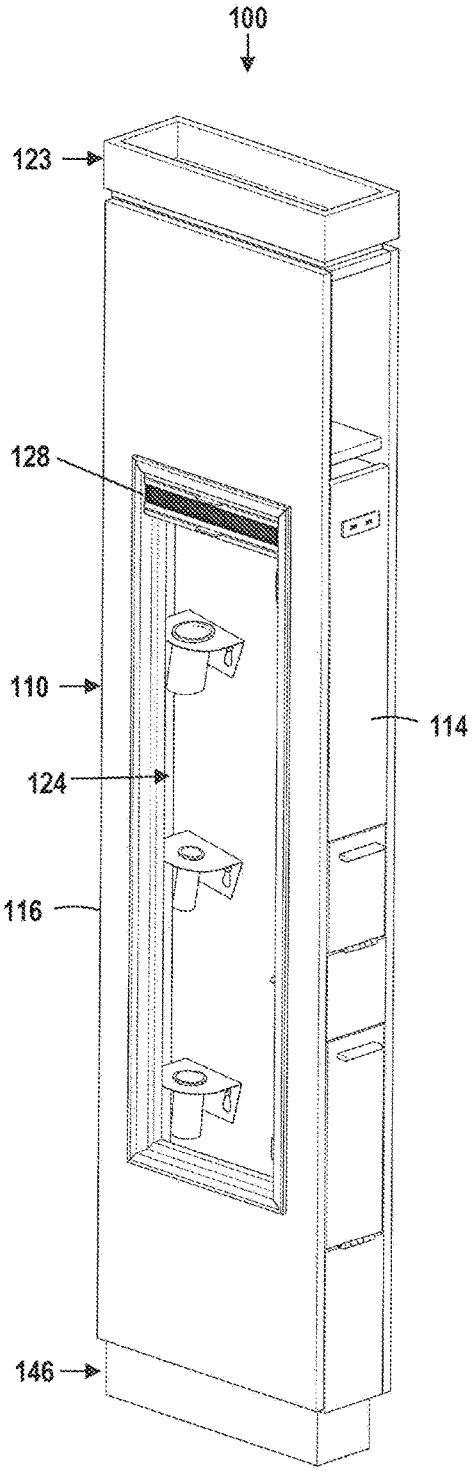
FIG. 11 is a further alternate perspective view of the second embodiment assembly.

In embodiments, cavity 126 may be open to the exterior of assembly 100. As shown in FIG. 10, this may be accomplished through the use of a set of hinges 130 between walls 112 and 116 to allow wall 112 to be pivoted open relative to the reminder of assembly 100.

Assembly front wall 114 may include one or more storage cavities 132 proximate top wall 120. In embodiments, a storage cavity 132 may include a storage shelf 134. An electrical outlet 136, such as a USB outlet or another standard electrical outlet, may be located adjacent storage cavities 132 and shelves 134. Storage cavity 132 may be used to store stylist hair products or other items. Shelf 134 may be used to store electrical objects such as cells phones, tablets or the like. Electrical outlet 136 may be used to provide power to electrical objects on shelf 134.

Assembly front wall 114 may also include one or more foldable panels 138 for holding a salon tool, such as a cordless trimmer. Panels 138 are jointed to wall 114 by a hinge element 140 and include may include a handle element 142. In embodiments, a panel 138 may include an internal shelf 143.

Assembly rear wall 116 may include an aperture 144 extending through wall 116 and into cavity 126. In embodiments, aperture 144 may be used to direct power cords into cavity 126 in order to supply power to assembly outlets and/or other assembly elements. When installed within a salon, assembly 100 rear wall 116 may be positioned against a salon wall or like surface.

Assembly bottom wall 122 may be adapted to mount storage assembly 10 to a floor or to another support surface within a salon work station.

In embodiments, assembly 100 may have a bottom soffit element 146 located below bottom wall 122. As shown in the figures, bottom soffit element 146 may be generally rectangular in shape and be used to integrate assembly 10 within certain salon build plans.

Figure 12:
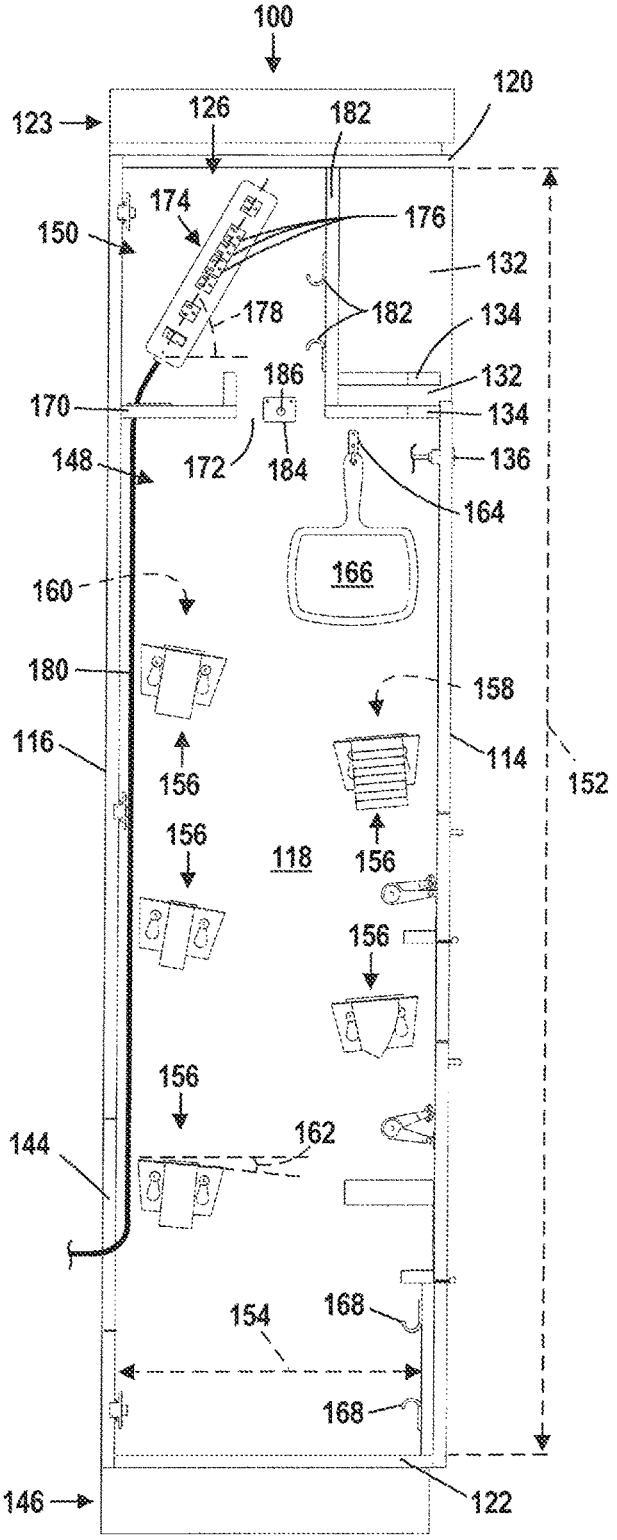
FIG. 12 is a sectional side view of the second embodiment assembly.

FIG. 12 is a sectional side view of storage assembly 100 having side wall 112 removed to illustrate elements within cavity 126.

Cavity 126 includes salon tool-storage cavity 148 and power-supply cavity 150 located proximate top wall 120 and above cavity 148.

Cavity 126 has a generally rectangular cross-section having a major vertical axis 152 extending generally between assembly top and bottom walls 120, 122 and a minor horizontal axis 154 extending generally between assembly front and rear walls 114, 116.

Assembly 100 wall 118 includes a number of salon tool supports 156 located in tool-storage cavity 130.

Salon tool supports 156 may be substantially identical to salon tool supports 44 described above, having a tool capture element and a support mounting bracket having mounting apertures to facilitate affixing salon tool supports to wall 118 through the use of one or more conventional fasteners as shown in the figures.

In embodiments, assembly 100 salon tool supports 156 may be located in first and second groups 158, 160 located adjacent walls 114 and 116 respectively. As shown in the figures, first group 158 is located proximate wall 114 and is made up of two salon tool supports 156 vertically offset from each other along major axis 152. Similarly, second group 160 is located proximate wall 116 and is made up of three salon tool supports 156 vertically offset from each other along major axis 152. See FIG. 12.

In embodiments, salon tool supports 156 in first and second groups 158, 160 are vertically offset from each other along major axis 152. As shown in the figures, this locates supports 156 in an alternating pattern along opposed walls 114, 116 so that supports on opposed sides of assembly 100 are vertically offset from one another. This location of supports 156 facilitates the positioning of tool power cords in assembly 100 as explained further herein.

While the application figures show use of five salon tool supports 156 in groups 158, 160, embodiments of assembly 100 are contemplated having a different number of salon tool supports, including an embodiment having a single salon tool support 156 located proximate wall 114 and a single salon tool support 156 located proximate wall 116 and an alternate embodiment having a single salon tool support 156.

In embodiments, the tool capture element of a salon tool supports 156 may be mounted to wall 118 at an angle 162 relative to minor axis 152. Likewise, the flange wall and cavity mouths of salon tool supports 156 are located at like angle 162 relative to minor axis 136. In specific embodiments, each salon tool support 156 faces generally toward the center of assembly 100 so that the supports 156 of first group 158 face the supports 156 of second group 160. This configuration facilitates the storage of corded salon tools as explained in greater detail below. In embodiments, angle 162 may be in a range of approximately 10 to 30 degrees. See FIG. 12.

In embodiments, assembly 100 wall 118 may include additional hooks or like conventional supports 164 for mounting additional accessories within assembly 100. For example, FIG. 12 shows the mounting of a hand mirror 166 to supports 164.

Assembly 100 salon tool-storage cavity 148 may include one or more cord hooks 168 or like restraints to facilitate organizing cords within cavity 148. FIG. 12 shows a pair of cord hooks 168 on wall 114.

Power-supply cavity 150 is separated from salon tool-storage cavity 148 by wall 170. Wall 170 includes an aperture 172 to facilitate the routing of wires between cavities 148 and 150 as explained in greater detail herein.

Power-supply cavity 150 includes an electrical supply 174 mounted to wall 118 proximate top wall 120. Electrical supply 174 may be similar to electrical supply 74 disclosed herein, having one or more electrical outlets 176 adapted for receiving conventional power cord plugs. Electrical outlets 176 may be located at different locations along to major axis 152 and minor axis 154. In embodiments, electrical supply 174 may be mounted to wall 118 at an angle 178 relative to minor axis 152 so that aligned outlets 176 are oriented at likewise angle 178 relative to minor axis 152.

In embodiments, electrical supply 174 may be a multiplex electrical outlet having multiple conventional electrical outlets as shown in the figures. In such embodiments, a power cord 180 for the multiplex electrical outlet is routed through cavity 126 and through an aperture in wall 170 downwardly along wall 116 to aperture 144 and outward from assembly 10 to a conventional power supply outlet.

In embodiments, power-supply cavity 150 may include one or more cord hooks 182 or like restraints to facilitate organizing cords within cavity 150. FIG. 12 shows a pair of cord hooks 182 on cavity wall 182.

Cavity 126 includes cord-management support 184 located in aperture 172 generally between cavities 148 and 150 and between electrical supply 174 and salon tool supports 156 along major axis 152.

As shown in the figures, cord-management support 184 may be formed from a generally rigid rod 186 for positioning cords as explained in greater detail below.

In embodiments, cord-management support 184 may be substantially identical to cord-management support 78 disclosed above. Likewise, the use of a cord-management support having different elements than support 184 is contemplated, including supports having rigid restraints such as hooks, apertures through solid bodies and the like, flexible restraints such as ties, hooks and loops type ties as well as other elements capable of engaging and securing power cords extending between electrical supply 174 and salon tool supports 156 as explained in greater detail below.

Use of assemblies 10 and 100 will now be described.

Figure 7:
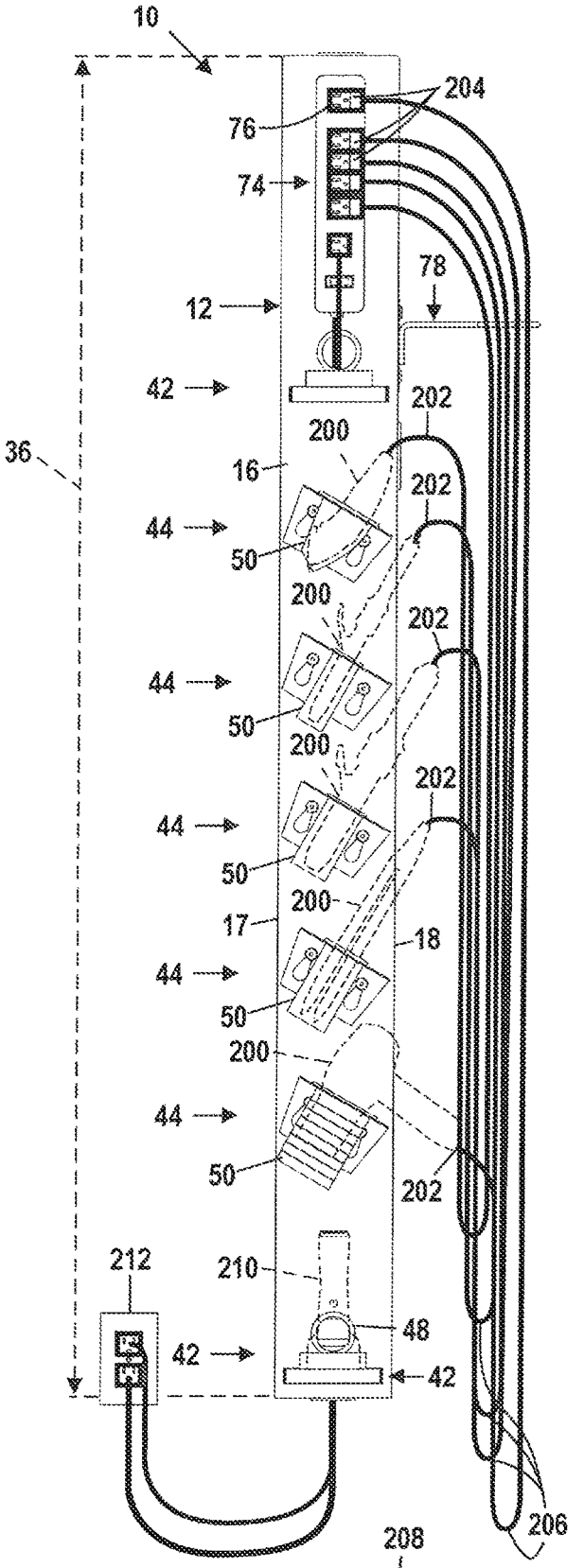
FIG. 7 is front view of the assembly having a number of corded styling tools installed therein.

FIG. 7 is a front view of storage assembly 10 showing storage of a number of corded styling tools 200 therein. Each tool 200 has a corresponding power cord 202.

Each tool 200 is placed into a salon tool support 44 so that a portion of a tool 200 is located within a cavity 56 of an appropriately-shaped tool capture element 50. A cord plug 204 located at the free end of a cord 202 is inserted into an electrical outlet 76 at electrical supply 74.

Each tool 200 placed within a support 44 so that each corresponding power cord 202 extends away to a side of assembly 10 support column 12.

The orientation of salon tool supports 44, inclusive of tool capture element 50, determine whether power cords 202 extend away from column 12 adjacent to right side wall 17 or left side wall 18. As shown in FIG. 10, salon tool supports 44 face side wall 18, thus orienting power cords 202 adjacent to side wall 18. In the mirror-image configuration of assembly 10' shown in FIG. 8, salon tool supports 44 face side wall 17, thus orienting power cords 202 adjacent to side wall 17.

The mounting of salon tool supports 44, at an angle 70 facilitates directing power cords 202 to one side or the other of support column 12.

Each cord 202 extends from a cord plug 204 downwardly from electrical supply 74 to cord-management support 78. Support 78 engages and holds each cord 202 to facilitate the positioning of power cords 202 to a side of support column 12. Each cord extends further downwardly from support 78 to a cord loop vertex 206 located proximate column bottom 40 and below cord-management support 78.

As shown in FIG. 7, each cord loop vertex 206 is located above a salon site floor 208. The positioning of tool power cords 202 above floor 208 so that they do not come in contact with floor 208 prevents cord entanglement and tripping hazards.

Cords 202 are extend generally parallel to one another along major axis 36 to one side of support column 12. Tool cords 202 are positioned by assemblies 10 and 10' to form a generally parabolic or J-shape between a tool 200 in a salon tool support 44 and cord-management support 78.

The generally parabolic or J-shaped configuration of tool cord 202 locates that the majority of cord 202 vertically parallel to axis 36. This allows the storage of multiple cords 202 adjacent to support column 12 with a reduced entanglement risk between adjacent cords. In use by a stylist, individual tools 200 may be removed from and replaced to assembly 10 or 10' without substantially disturbing or becoming entangled with other power cords located therein.

In use of assembly 100, tools 200 having longer cords 202 may be stored in a support 44 located proximate the top of the assembly to properly locate the cord 202 therein.

In embodiments, assembly 10 allows installation of cordless, battery powered salon tool 210 stored in a corresponding charger base on shelf 42. A power cord for the charger base cord may extend through aperture 48 to internal cavity 22 and power supply outlet 212.

As indicated, power cords for assembly elements such as electrical supply 74 and the charger base for salon tool 210 may be routed to the interior of assembly 10 or 10' through internal cavity 22 and the bottom of the assembly to engage a conventional power supply outlet 212.

Figure 13:
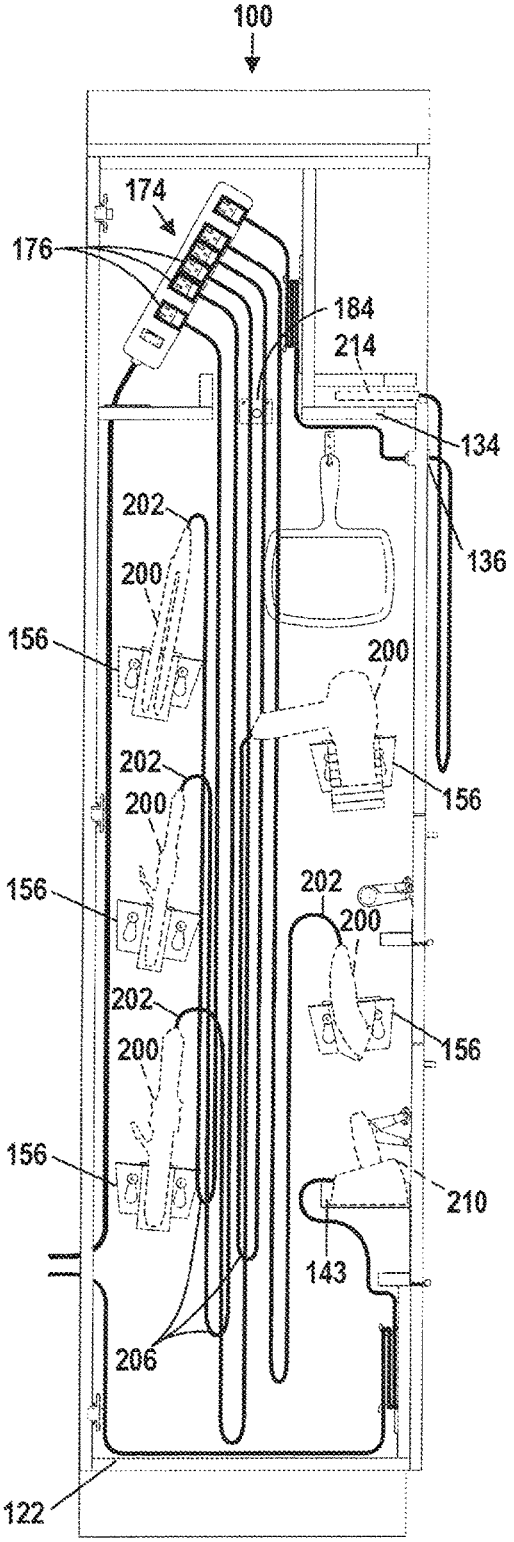
FIG. 13 is sectional side view of the second embodiment assembly having a number of corded styling tools installed therein.

FIG. 13 is a side view of storage assembly 100 showing storage of a number of corded styling tools 200 therein. Each tool 200 has a corresponding power cord 202.

Similar to use of assembly 10, 10', each tool 200 is placed into a salon tool support 156 so that a portion of a tool 200 is located within a support cavity of an appropriately-shaped tool capture element.

A cord plug 204 located at the free end of a cord 202 is inserted into an electrical outlet 176 at electrical supply 174.

Each tool 200 placed within a support 156 so that each corresponding power cord 202 extends away to the center of assembly cubic body 110 within tool-storage cavity 148.

As shown in the figures, the orientation of support 156, inclusive of a corresponding support tool capture element, determine the positioning of power cords 202 toward the center of assembly cubic body 110 within tool-storage cavity 148. As indicated herein, supports 156 located adjacent to side wall 17 face away from wall 17 and toward the center of cubic body 110, thus orienting power cords 202 away from wall 17 and toward the center of cubic body 110. Likewise, supports 156 located adjacent to side wall 18 face away from wall 18 and toward the center of cubic body 110, thus orienting power cords 202 away from wall 18 and toward the center of cubic body 110.

The mounting of salon tool supports 44, at an angle 162 facilitates directing power cords 202 toward the center of cubic body 110.

Each cord 202 extends from a cord plug 176 downwardly from electrical supply 174 to cord-management support 184. Support 184 engages and holds each cord 202 to facilitate the positioning of power cords 202 toward the center of cubic body 110. Each cord extends further downwardly from support 184 to a cord loop vertex 206 located proximate assembly bottom wall 122 and below cord-management support 184.

As shown in FIG. 13, each cord loop vertex 206 is located above the interior of bottom wall 122. The positioning of tool power cords 202 above wall 122 so that they do not come in contact with wall 122 prevents cord entanglement. Likewise, the positioning of tool power cords 202 above a salon site floor upon which assembly 100 is installed prevents potential cord tripping hazards.

Cords 202 are extend generally parallel to one another along major axis 152. Tool cords 202 are positioned by assembly 100 to form a generally parabolic or J-shape between a tool 200 in a salon tool support 156 and cord-management support 184.

The generally parabolic or J-shaped configuration of tool cord 202 locates that the majority of cord 202 vertically parallel to axis 156. This allows the storage of multiple cords 202 within assembly 100 with a reduced entanglement risk between adjacent cords. In use by a stylist, individual tools 200 may be removed from and replaced to assembly 100 without substantially disturbing or becoming entangled with other power cords located therein.

In use of assembly 100 tools 200 having longer cords 202 may be stored in a support 156 locate proximate the top of column 12 to properly locate the cord 202 adjacent column 12.

In embodiments, assembly 100 allows for the installation of an cordless, battery powered salon tool 210 stored in a corresponding charger base on shelf 143. A power cord for the charger base cord may be routed through the internal cavity of assembly 100, with any excess cord length contained by cord hooks 168.

In embodiments, assembly 100 allows for the storage of an electronic device 214, such as a cellular phone, computer tablet or the like on a shelf 134. Device may be powered though use of outlet 136. See FIG. 13.

Figure 14:
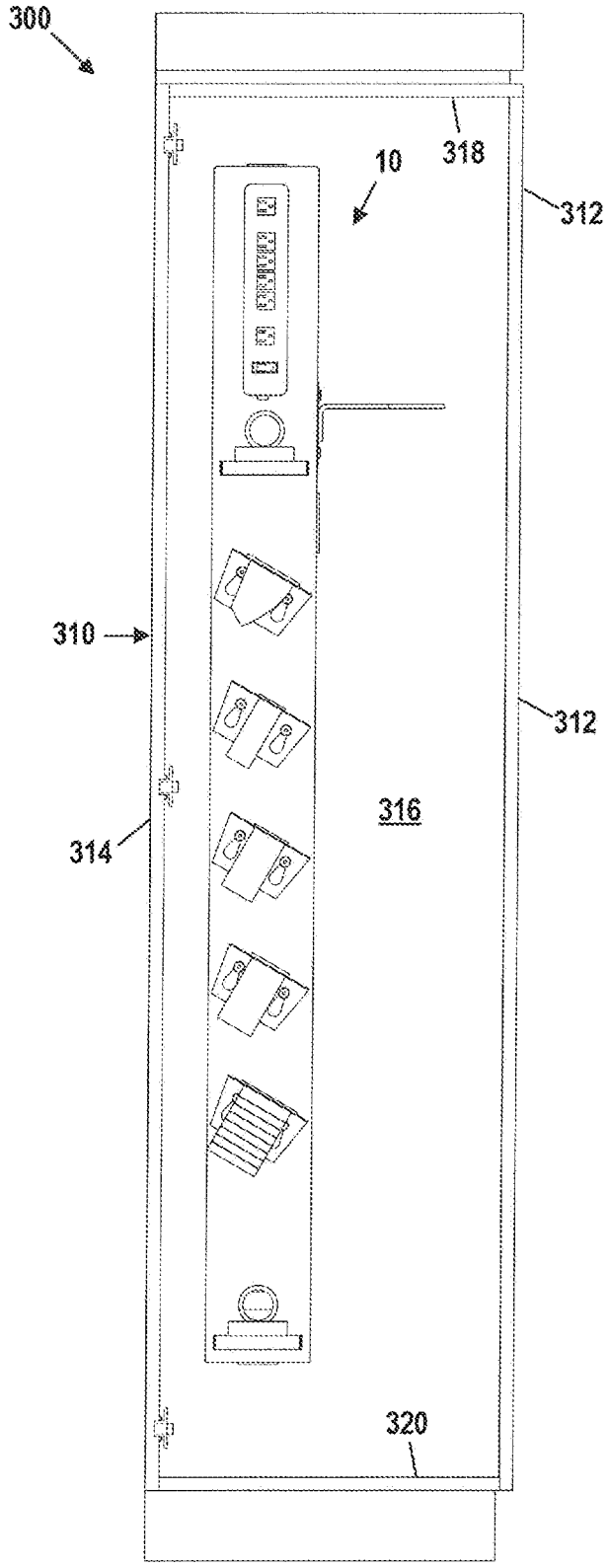
FIG. 14 is a sectional side view of a third embodiment assembly.

FIG. 14 shows a third embodiment storage assembly 300.

Storage assembly 300 discloses the installation of a first embodiment storage assembly 10 within a rectangular body 310 having the general form of a storage cabinet similar to rectangular cubic body 110 described above.

Body 310 has right side wall (not shown), a front wall 312, a rear wall 314, a side wall 316 and top and bottom walls 318, 320.

In embodiments, the right side wall of body 310 may be similar to the right side wall 112 of assembly 100 as described above and adapted to allow access to the interior of body 310.

As shown in FIG. 14, storage assembly 10 is mounted directly to side wall 316. This allows for the installation of assembly 300 customizable to specific salon floorplans as well as to conceal salon tools and cords within body 310. In further embodiments, body 310 may be sized to include additional shelves or storage compartments to hold additional salon equipment.

In yet further embodiments, elements of assembly 10 may be mounted directly to the interior of one or more walls of body 310, similar to assembly 100 as described above.

Use of assembly 300 is similar to that of assemblies 10 and 100.

While one or more embodiments of the assembly have been disclosed and described in detail, it is understood that this is capable of modification and that the scope of the disclosure is not limited to the precise details set forth but includes modifications obvious to a person of ordinary skill in possession of this disclosure and also such changes and alterations as fall within the purview of the following claims.

What is claimed is:

1. A tool storage assembly comprising:

an assembly body having an assembly top and an assembly bottom and an assembly wall comprising a first salon tool support located at a first position on said assembly wall and a second salon tool support located at a second position on said assembly wall, each said salon tool support comprising a tool capture element, wherein each tool capture element is mounted to the assembly wall; a vertical axis extends between said assembly top and assembly bottom and a horizontal axis extending between opposed assembly sides, said first position is above said second position along said vertical axis;

said assembly body further comprising an electrical supply having a plurality of electrical outlets located at a third position above said first position and said second position, and the electrical outlets are positioned in a vertical configuration relative to each other along said vertical axis;

said assembly body further comprising a cord-management support comprising a rigid support extending away from said assembly body to a cord containment element located a distance away from said assembly body and, said cord-management support located between said electrical supply and said salon tool supports;

a salon tool located in one of said tool capture elements, said salon tool comprising a tool cord extending from said salon tool to a cord plug, said cord plug is plugged into one of said electrical outlets and said tool cord is configured to engage said cord containment element, said tool cord has a generally parabolic configuration, adjacent to said assembly body and having a cord linear portion extending generally parallel to said vertical axis, said tool cord comprising a loop vertex located below said cord-management support and said electrical outlets wherein said loop vertex is located above a site floor.

2. The assembly of claim 1 wherein said assembly wall is generally rectangular in shape.

3. The assembly of claim 2 wherein said salon tool supports comprise a support mounting bracket, said support mounting bracket affixing said salon tool supports to said assembly wall.

4. The assembly of claim 3 wherein said tool capture elements are generally cylindrical in shape.

5. The assembly of claim 4 wherein said tool capture elements face an assembly side and said tool capture elements are oriented at an angle relative to said horizontal axis.

6. The assembly of claim 5 wherein said angle is between 10 and 30 degrees.

7. The assembly of claim 1 wherein said cord-management support rigid support comprises a wire and said cord containment element comprises a loop portion, said loop portion engaging said tool cord.

8. A tool storage assembly comprising a first salon tool support located at a first position on an assembly wall and a second salon tool support located at a second position on said assembly wall, said first position above said second position, each said salon tool support comprising a tool capture element having a generally cylindrical shape cavity; said assembly wall having an wall top and a wall bottom and opposed first and second wall sides a vertical axis extending between said wall top and wall bottom and a horizontal axis extending between said first and second wall sides, said first position and said second positon is along said vertical axis, wherein each cavity of each salon tool support is tilted at an angle relative to said vertical axis; said assembly body further comprising an electrical supply having a plurality of electrical outlets located at a third positon above said first positon and said second position, said third position is along said vertical axis; said assembly body further comprising a cord-management support comprising a rigid support extending away from said assembly wall to a cord containment element located a distance away from said assembly wall, said cord-management support located between said electrical supply and said salon tool supports; a salon tool comprising a tool cord extending from said salon tool to a cord plug, said salon tool is located in a corresponding cavity of one of said tool capture elements and said tool cord plug is plugged into one of said electrical outlets and said tool cord is configured to engage said cord containment element, said tool cord oriented in a generally parabolic configuration and comprising a loop vertex located below said cord-management support and said electrical outlets wherein said loop vertex is located above a site floor.

9. The assembly of claim 8 wherein said cord-management support comprises a wire and said cord management element comprises a loop portion, loop portion engaging said tool cord.

10. The assembly of claim 9 wherein said electrical outlets are positioned in a vertical configuration relative to another.

11. The assembly of claim 9 wherein said assembly wall comprises a storage cabinet comprising an internal assembly storage cavity, said a plurality of salon tool supports located within said storage cavity.

12. A tool storage assembly comprising:

an assembly body having a front wall and opposed first and second side walls, said front wall extending vertically between a top of the assembly body and a bottom of the assembly body, and the front wall spans horizontally between said opposed first and second side walls;

a first salon tool support mounted on said front wall at a first position on said front wall;

a second salon tool support mounted on said front wall at a second position on said front wall; wherein said second position is below said first position;

wherein each of the first and second salon tool supports comprise a generally L-shaped support mounting bracket and a cavity, each support mounting bracket is configured to affix each salon tool support to said front wall;

an electrical supply having a plurality of electrical outlets located at a third position on said front wall, said third position is above said first and second positions;

a cord management element located at a fourth position on said assembly body, said fourth position is below said third position and is above said first and second positions, said cord management element comprising a rigid support extending away from said assembly body to a cord containment element located a distance away from said assembly body;

said first salon tool support and said second tool support are in vertical alignment with one another;

a salon tool located in said cavity of said first salon tool support, said salon tool comprising a tool cord, said tool cord extending from said salon tool to a cord plug, said cord plug is plugged into one of said electrical outlets and said tool cord is configured to engage said cord containment element wherein said tool cord comprises a generally parabolic configuration having a cord linear portion extending from a loop vertex located below said salon tool to said cord containment element.

13. The assembly of claim 12 wherein said front wall is generally rectangular in shape.

14. The assembly of claim 12 wherein each cavity is generally cylindrical in shape.

15. The assembly of claim 12 wherein said electrical outlets are in a vertical alignment relative to another.

16. The assembly of claim 15 wherein each of said electrical outlets are positioned in vertical alignment with said first salon tool support and said second salon tool support.

17. The assembly of claim 12 wherein said rigid support comprises a wire and said cord containment element comprises a loop portion, loop portion engaging said tool cord.

18. The assembly of claim 12 wherein said cord management element is located on said front wall.

19. The assembly of claim 12 wherein said cord management element is located on said side wall.

* * * * *